US010808738B2

(12) United States Patent
Doll et al.

(10) Patent No.: US 10,808,738 B2
(45) Date of Patent: Oct. 20, 2020

(54) METHOD FOR THE SUPPLY OF COMPRESSED AIR TO A COMPRESSED-AIR CONSUMER, VALVE DEVICE AND DATA CARRIER WITH A COMPUTER PROGRAM

(71) Applicant: Festo SE & Co. KG, Esslingen (DE)

(72) Inventors: Matthias Doll, Wernau (DE); Rudiger Neumann, Ostfildern (DE); David Rager, Esslingen (DE)

(73) Assignee: FESTO SE & CO. KG, Esslingen (DE)

( * ) Notice: Subject to any disclaimer, the term of this patent is extended or adjusted under 35 U.S.C. 154(b) by 0 days.

(21) Appl. No.: 16/094,114

(22) PCT Filed: Apr. 11, 2017

(86) PCT No.: PCT/EP2017/058637
§ 371 (c)(1),
(2) Date: Oct. 16, 2018

(87) PCT Pub. No.: WO2017/182325
PCT Pub. Date: Oct. 26, 2017

(65) Prior Publication Data

US 2019/0120264 A1 Apr. 25, 2019

(30) Foreign Application Priority Data

Apr. 21, 2016 (DE) ..... 10 2016 206 822

(51) Int. Cl.
*F15B 21/02* (2006.01)
*F15B 11/00* (2006.01)
(Continued)

(52) U.S. Cl.
CPC ..... *F15B 21/02* (2013.01); *F15B 11/006* (2013.01); *F15B 11/06* (2013.01); *F15B 11/165* (2013.01);
(Continued)

(58) Field of Classification Search
CPC ..... F15B 11/006; F15B 11/06; F15B 11/068
See application file for complete search history.

(56) References Cited

U.S. PATENT DOCUMENTS 7,021,191 B2 * 4/2006 Moler ..... F15B 11/006 91/393
7,269,947 B2 * 9/2007 Yoshino ..... F15B 11/006 60/469
(Continued)

FOREIGN PATENT DOCUMENTS

DE 102006058913 6/2008
DE 102009017879 10/2010
(Continued)

OTHER PUBLICATIONS

Abry, et al., "Piston Position Estimation for an Electro-Pneumatic Actuator at Standstill," Control Engineering Practice, 41 (2015), pp. 176-185.

*Primary Examiner* — Michael Leslie
(74) *Attorney, Agent, or Firm* — Hoffmann & Baron, LLP

(57) ABSTRACT

A method for the supply of compressed air of a compressed-air consumer having two fluidically separate, kinematically coupled working areas, wherein each of the working areas is assigned to a valve arrangement which can be independently controlled and can be configured between a blocking position, a first functional position for a fluidically communicating connection to a fluid course and a second functional position for a fluidically communicating connection to a fluid sink and wherein each of the two valve arrangements is configured individually depending on a predefinable movement task for the compressed-air consumer and depending, on at least two pressure values from the following group: supply pressure, first working area pressure, second working area pressure, discharge pressure, for a provision of a predefinable developing for a fluid mass flow
(Continued)

or for a provision of a predefinable developing for a fluid pressure in the respective working area or for a provision of a predefinable developing of a valve cross-section.

8 Claims, 1 Drawing Sheet

(51) Int. Cl.
*F15B 11/06* (2006.01)
*F15B 11/16* (2006.01)
*F15B 21/08* (2006.01)

(52) U.S. Cl.
CPC ..... *F15B 21/08* (2013.01); *F15B 21/082* (2013.01); *F15B 21/085* (2013.01); *F15B 2211/30575* (2013.01); *F15B 2211/6306* (2013.01); *F15B 2211/6309* (2013.01); *F15B 2211/6313* (2013.01)

(56) References Cited

U.S. PATENT DOCUMENTS

| | | | | |
|---|---|---|---|---|
| 7,380,398 | B2 * | 6/2008 | Pfaff | F15B 11/006 60/327 |
| 2015/0197915 | A1 | 7/2015 | Zhang et al. | |
| 2017/0234333 | A1 * | 8/2017 | Wirtl | F15B 11/006 91/459 |
| 2018/0245608 | A1 * | 8/2018 | Doll | F15B 13/085 |
| 2019/0136880 | A1 * | 5/2019 | Neumann | F15B 11/006 |

FOREIGN PATENT DOCUMENTS

| | | |
|---|---|---|
| DE | 102014004877 | 9/2015 |
| WO | WO2004065798 | 8/2004 |
| WO | WO2010118802 | 10/2010 |
| WO | WO2016023569 | 2/2016 |

* cited by examiner

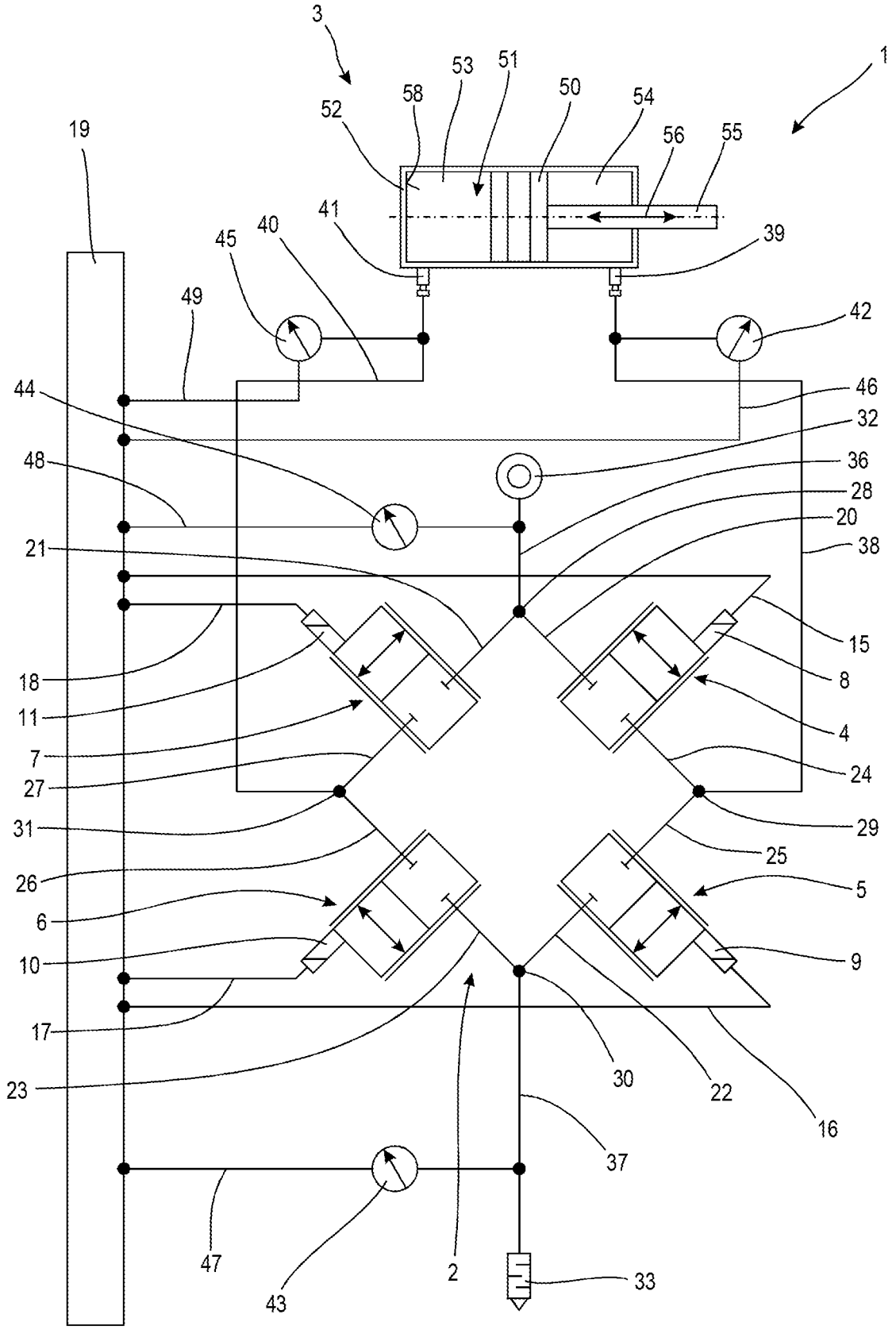
3
1
53
51
58
50
54
52
56
55
19
41
40
39
45
49
42
44
46
32
48
36
28
20
21
38
15
18
8
11
4
7
24
27
31
29
25
26
5
6
10
9
17
30
23
22
16
37
47
2
33
43

METHOD FOR THE SUPPLY OF COMPRESSED AIR TO A COMPRESSED-AIR CONSUMER, VALVE DEVICE AND DATA CARRIER WITH A COMPUTER PROGRAM

This application claims priority based on an International Application filed under the Patent Cooperation Treaty, PCT/EP2017/058637, filed on Apr. 11, 2017, which claims priority to DE 10 2016 206 822.9 filed on Apr. 21, 2016.

BACKGROUND OF THE INVENTION

The invention relates to a method for the supply of compressed air to a compressed-air consumer having two fluidically separate, kinematically connected working spaces, wherein each of the working spaces is assigned to a valve arrangement that can be independently controlled, said valve arrangement being able to be configured between a blocking position, a first functional position for a fluidically communicating connection to a fluid source and a second functional position for a fluidically communicating connection to a fluid sink. The invention further relates to a valve device for the operation of a compressed-air consumer and a data carrier with a computer program for storage in a processing device of a valve device.

According to a prior art that is known to the applicant but not published in print, a method for the supply of compressed air to a compressed-air consumer a position of a mobile component of the compressed-air consumer is provided, for example a working piston of a pneumatic cylinder to be determined longitudinal to a movement path with the help of a position measuring system and a position signal provided by the position measuring system on a processing device in which processing of the position signal is carried out to, for example, obtain at least some information about a movement of the mobile component of the compressed-air consumer from an absolute value for the position signal and/or a temporal change in the position signal. This information can then be used to control a valve arrangement assigned to the processing device to influence a fluid flow in a working space or a working space of the compressed-air consumer such that the mobile components of the compressed-air consumer can be moved to a predefined position longitudinal to the movement path and/or at a predefined speed longitudinal to the movement path. A valve position of the valve arrangement can therefore be controlled or regulated on the basis of the position signal of the position measuring system. Depending on the pressure conditions in the compressed-air consumer and a compressed air source, the change in the valve position leads to various fluid volume flows to the compressed-air consumer that are recorded indirectly by the processing device by means of the position signal from the position measuring system and lead to a further adjustment of the valve position.

SUMMARY OF THE INVENTION

The object of the invention is to provide a method for supply of compressed air to a compressed-air consumer, a valve device and a data carrier with a computer program for storage in a processing device of a valve device, by means of which improved provision of compressed air for a compressed-air consumer is enabled.

This object is achieved for a method of the type mentioned as mentioned above, wherein each of the two valve arrangements being individually configured depending on a definable movement task for the compressed-air consumer and depending, preferably exclusively, on at least two pressure values from the following group: supply pressure, first working area pressure, second working area pressure, discharge pressure, for a provision of a predefinable developing for a fluid mass flow or for a provision of a predefinable development of a fluid pressure in the respective working area or for a provision of a predefinable development of a valve cross-section.

In a compressed-air consumer designed as an actuator, in particular a pneumatic cylinder, a movement task can for example consist of moving a machine component coupled to the compressed-air consumer longitudinal to a movement path, in particular a straight path, from a first functional position to a second functional position. Furthermore, the movement task can comprise further boundary conditions such as a maximum time period for the movement of the machine component and/or a minimum and/or a maximum acceleration when the machine component is moved. In order to fulfil the conditions of the movement task, coordination is necessary to control the two valve arrangements, which for example is carried out by a processing device. This coordination comprises the determination of at least two pressure values which can be determined with the help of pressure sensors on or in fluid lines, by means of which the valve arrangements are connected to the compressed-air consumer or to a fluid source or fluid sink. Particularly preferably, the coordination of the control of the two valve arrangements is carried out exclusively on the basis of pressure values so that complex measuring devices such as a position measuring system are not needed. A pressure provided by a fluid source is known as a supply pressure. A pressure that is found in a working area of the compressed-air consumer is known as a working area pressure. A pressure on a fluid outlet of a valve arrangement is known as a discharge pressure.

The processing device provided to carry out the method is used to control the two valve arrangements and controls the two valve arrangements in such a way that a developing of a fluid mass flow or a fluid pressure can be predefined for at least one of the two working areas or a valve cross-section of the valve arrangement that is assigned to the respective working area can be configured.

Advantageous further developments of the invention are the subject matter of the dependent claims.

It is expedient for aeration of a first working area with a predefinable developing for a first fluid mass flow and ventilation of a second working area with a predefinable developing for a second fluid mass flow to occur, in particular at a constant ratio between the first fluid mass flow and the second fluid mass flow. As a result of this, fluid mass flows for the working areas of a pneumatic cylinder designed to be double-acting that is provided for the movement of a machine component can for example be configured such that a movement speed of a piston rod of the pneumatic cylinder is within a predefinable window of speed and braking of the piston rod occurs immediately before a mechanical end position for the machine component and/or the piston rod is reached. This braking prevents the machine component and/or the piston rod striking an end stop and wearing down as a result. The fluid mass flows for the working areas of the compressed-air consumer can also be measured such that the braking occurs as a result of the energy-efficient operation of the compressed-air consumer. In order to do this, it is possible, for example, for an energy supply on the compressed-air consumer that occurs as a result of the provision of compressed air to be measured such that the energy supplied is precisely sufficient to move the compressed-air consumer from a first functional position into a second functional position without additional energy needing to be supplied to brake the compressed-air consumer at the end of the movement. When a compressed-air consumer in which the size ratio between the two working areas of changing sizes is supplied, uniform movement of the compressed air actuator can be brought about by means of the provision of fluid flows to the respective working areas, which are also at a constant ratio relative to one another.

This applies in particular if a constant developing is provided for the first fluid mass flow and for the second fluid mass flow.

A further development of the method provides for aeration of a first working area with a predefinable developing for a first fluid pressure and a ventilation of a second working area with a predefinable developing for a second fluid mass flow or a predefinable developing for a valve position of the valve arrangement assigned to the second working area. Aeration of the first working area with a predefinable developing for the first fluid pressure is of particular interest if the compressed-air consumer, which in particular can be a pneumatic cylinder, is oversized for the movement task to be carried out. This can for example be the case if standard cylinders are used in a machine construction for cost and/or availability reasons. These standard cylinders may provide a greater stroke and/or a greater maximum force than that needed by the movement task. In such a case, limiting the fluid pressure provided in the working area to be aerated ensures energy-efficient operation of the compressed-air consumer despite the compressed-air consumer being oversized. In an operation of this type, we can also speak of a virtual supply pressure for the compressed-air consumer that is provided with the help of the valve arrangement that is assigned to this working area. By specifying a fluid mass flow for the aeration of the other working room, a defined, in particular constant, movement speed can be ensured for the actuator element of the compressed-air consumer. Alternatively, it is possible to provide for a valve position for the valve arrangement that is connected to the working area to be relieved to be impacted according to a predefined developing to limit a maximum speed for the actuator element in a simple manner.

A further embodiment of the method provides for a position of a mobile actuator element that is received in an actuator housing to be determined using at least one fluid mass flow that flows through one of the valve arrangements. In this way it is possible to determine a position of the actuator element without a complex measuring system. This applies for example in an embodiment where the compressed-air consumer is designed as a pneumatic cylinder in which the actuator element can be formed by the working piston and the piston rod connected to it. The position determined in this way can for example be used to influence a path of motion for the compressed-air consumer, for example to ensure the smooth start-up of a position.

Preferably, there are provisions for the at least one fluid mass flow to be determined using the following steps: Determination of a first fluid pressure in a first section of a fluid channel of a valve arrangement that extends between an inlet connection for a fluidically communicating connection to a fluid source or fluid sink, and a valve element; determination of a second fluid pressure in a second section of the fluid channel of the valve arrangement that extends between the valve element and an outlet connection for a fluidically communicating connection to a compressed-air consumer; determination of a flow value for the valve element from the two fluid pressures and a flow function; linking the flow value to a predefinable fluid volume flow or fluid mass flow for the pressurised fluid that is provided to flow through the fluid channel to a fluid-related conductivity value and determination of the necessary actuating energy for an actuating device that is designed to actuate the valve element and provision of the actuating energy to the actuating device to set the predefinable fluid volume flow or fluid mass flow.

The objective of this method is therefore to be able to use the pressure values determined and knowledge of the fluid technology properties of the valve element used to set a fluid volume flow or fluid mass flow for the compressed-air consumer to a predefinable fluid volume flow and therefore directly influence the movement behaviour of the compressed-air consumer which for example is a compressed air drive, in particular a pneumatic cylinder or pneumatic swivel drive. The fluid volume flow describes the flowing fluid volume per unit of time. The density of the fluid is also taken into account in fluid mass flows, thereby reducing the calculation effort. Thus the measuring efforts for the open-loop control or the closed-loop control of a supply of compressed air to compressed-air consumers can also be kept low. This is achieved in particular in that only pressure sensors designed to determine fluid pressures in the respective sections of the fluid channel of the valve arrangement are necessary to carry out the method. Apart from the fact that this means a typically highly cost-intensive position measuring system is no longer necessary, there are further advantages as a result of the fact that pressure sensors can be arranged in immediate proximity to the valve element and a processing device that is designed to evaluate the pressure signals coming from the pressure sensors and to control the actuating device. An electrical connection between the pressure sensors and the processing device can therefore be achieved with short electrical lines.

There are provisions to determine both the pressure in the first section of the fluid channel and the pressure in the second section of the fluid channel, wherein the valve channel sections are connected to one another in a fluidically separate manner or a fluidically communicating manner depending on a functional position of the valve element. Preferably it is provided that the valve element is free to move between a final position with a separate connection to the two sections of the fluid channels and an open position with a freely communicating connection to the two sections of the fluid channel depending on the provision of energy, in particular electrical or fluid energy, to an actuating device.

Once the first fluid pressure and the second fluid pressure have been determined, in a subsequent step a flow value is determined using the fluid pressures and a flow function. The flow function is for example an array of curves or a characteristic diagram showing flow properties of the valve element for a fluid that flows through the valve element depending on the pressure conditions before and after the valve element and further depending on a valve position of the valve element. The flow value determined is then linked to a predefinable fluid volume flow or fluid mass flow for the pressurised fluid to form a fluid-related conductivity value. This fluid-related conductivity value is needed to determine an actuating energy for the actuating device that is formed for the actuation of the valve element. The actuating energy determined is then provided on the actuating device to set the predefinable fluid volume flow or fluid mass flow.

Preferably there are provisions for the method described in greater detail above to be repeated in a cycle in order to enable, for example, a closed-loop control of at least one fluid volume flow or fluid mass flow for the compressed-air consumer.

In this approach, the valve arrangement is operated in the manner of a flow regulation valve, wherein unlike with a flow regulation valve no complex and cost-intensive mass flow sensor is needed as the entire determination of the fluid volume flow or fluid mass flow is carried out by means of the valve arrangement on the basis of the pressure values provided by the pressure sensors on or in the fluid channel.

Advantageous further developments of the invention are the subject matter of the dependent claims.

It is expedient if the flow value is determined from the flow function that is set as a ratio to a quotient of the first fluid pressure and the second fluid pressure and/or if the actuating energy is determined using the fluid-related conductivity value and a characteristic valve curve, in particular one determined by means of an experiment. The pressure ratio over the valve element that can be determined as a quotient of the first fluid pressure and the second fluid pressure is the parameter, by means of which a precise assignment to flow properties of the valve element for a fluid flowing through the valve element can be created regardless of the level of fluid pressure in the fluid channel. The characteristic valve curve creates a link between a provision of energy, in particular electrical or fluid energy, to the valve element and the resulting functional position for the valve element. Preferably there are provisions for the characteristic valve curve to be set relative to the fluid-related conductivity value determined in order to use this to determine the energy needed for the actuating device to achieve the desired functional position of the valve element.

The object of the invention is achieved for a valve device of the type mentioned at the outset that is used to supply compressed air to a compressed-air consumer and has two fluidically separate, kinematically coupled working areas, wherein each of the working areas is assigned to a valve arrangement that can be independently controlled and wherein each of the valve arrangements comprises of a fluid channel that is formed between an inlet connection for a fluidically communicating connection to a fluid source or fluid sink and an outlet connection for a fluidically communicating connection to a compressed-air consumer and a valve element that is arranged in a mobile manner in the fluid channel to influence a cross-section of the fluid channel and which valve element is assigned to an actuating device to change a functional position and a processing device to provide actuating energy to the actuating device, wherein a first pressure sensor is assigned to a first section of the fluid channel between the inlet connection and the valve element and wherein a second pressure sensor is assigned to a second section of the fluid channel between the valve element and the outlet connection, wherein the processing device is designed to carry out a method according to the invention.

A further embodiment of the valve device provides for the respective second sections of the respective fluid channels to be connected to a common outlet connection and for the inlet connections to be connected to various fluid sources or fluid sinks.

A further embodiment of the valve device provides for the processing device to be connected to two pairs of valve arrangements, each of which can be controlled independently of other, wherein the second sections of the respective fluid channels are each connected to a common outlet connection in pairs, and wherein a first inlet connection of each pair is connected to a fluid source and a second inlet connection of each pair is connected to a fluid sink, characterised in that the processing device is designed for synchronous supply of compressed air to the two working areas with predefinable fluid volume flows by means of the optional control of the respective valve arrangement.

The valve arrangement is preferably designed as a proportional valve, in particular as a fluidically pre-controlled proportional valve.

The object of the invention is achieved by means of a data carrier with a computer program that is designed to be stored in a processing device of a valve device, wherein the computer program initiates a method according to the invention, during processing in a processor of the processing device. The data carrier can be a portable storage medium such as a CD, DVD or USB memory device. Alternatively, the data carrier can be designed as a drive or solid-state memory on a data server in which a plurality of different data are stored that can be accessed remotely by the processing device, in particular on a data cloud.

BRIEF DESCRIPTION OF THE DRAWINGS

An advantageous embodiment of the invention is illustrated in the drawings, wherein:

FIG. 1 shows a schematic representation of a first embodiment of a fluid system with a valve device and a compressed-air consumer having two kinematically coupled working areas.

DETAILED DESCRIPTION OF THE PREFERRED EMBODIMENTS

A fluid system 1 shown in FIG. 1 is purely designed by way of an example to provide a linear movement, and in order to do this comprises a valve device 2 and a compressed-air consumer 3. By way of an example, the valve device 2 is created as a pneumatic full bridge circuit with a total of four valve elements 4, 5, 6 and 7 each designed as 2/2-way proportional valves, wherein each of the valve elements 4, 5, 6 and 7 is designed, purely by way of an example, as a solenoid valve with a magnetic drive 8, 9, 10 and 11 as an actuating device. In an alternative embodiment (not shown), the actuating device can also be designed as a piezo drive or a magnetostrictive or otherwise suitable drive.

Each of the valve elements 4, 5, 6 and 7 can be switched between two functional positions, in particular a blocking position and an open position, in the event of the suitable application of electrical energy to the assigned magnetic drives 8, 9, 10 and 11. In order to do this, the magnetic drives 8, 9, 10 and 11 are electrically connected to a processing device 19 by means of control lines 15, 16, 17 and 18, forming a component of the valve device 2 and for example comprising a microprocessor or microcontroller.

Each of the valve elements 4, 5, 6 and 7 is connected to fluid junctions 28 to 31 by means of assigned fluid lines 20 to 27 and forms a valve arrangement that is not described in greater detail with the respective fluid lines 20 to 27 that are assigned in pairs. Fluid lines 20 to 23 are known as the first section of a fluid channel of the respective vale element 4, 5, 6 and 7. Fluid lines 24 to 27, however, are known as the second section of a fluid channel of the respective vale element 4, 5, 6 and 7. Fluid lines 20 and 21 both end in a fluid junction 28, fluid lines 22 and 23 both end in fluid junction 30, fluid lines 24 and 25 both end in fluid junction 29 and fluid lines 26 and 27 both end in fluid junction 31.

Purely by way of an example fluid junction 28 is connected to a fluid source 32 by means of a supply line 36 while fluid junction 30 is connected to a fluid outlet by means of an exhaust line 37 that is assigned to a sound absorber 33. Fluid junction 29 forms a first working connection to the valve device 2 and is connected to a fluid connection 39 of compressed-air consumer 3 by means of a first connection line 38 while fluid junction 31 forms a second working connection of the valve line 2 and is connected to a fluid connection 41 of the compressed-air consumer 3 by means of a second connection line 40.

Purely by way of an example there is a provision for a pressure sensor 42 to 45 to be assigned to each of the supply line 36, the exhaust line 37, the first connection line 38 and the second connection line 40, which pressure sensor is designed to record the respective fluid pressure in the assigned line 36, 37. 38 and 40 and to provide a pressure-dependent sensor signal by means of a sensor line 46 to 49 assigned to the processing device 19 in each case. In a further embodiment (not shown), at least one of the pressure sensors is arranged in a housing for the valve device or outside of a housing of this type.

Purely by way of an example, the compressed-air consumer 3 is designed as a double-acting pneumatic cylinder in which a working piston 50 also designated a mobile wall is received in a cylinder recess 51 of a cylinder housing 52 in a linear manner and as a result separated a first variable-size working area 53 from a second variable-size working area 54. For example, the working piston 50 is connected to a piston rod 55 which penetrates the cylinder housing 52 on the front side and can be pushed together with the working piston 50 in a longitudinal direction along a straight movement path 56 relative to the cylinder housing 52.

Purely by way of an example, there will be a description below of which steps are to be carried out in fluid system 1 to effect a movement of the working piston 50 with the coupled piston rod 55 according to the predefinable movement profile. For example, the working piston 50 is to be moved starting from the position according to the representation in FIG. 1 such that a front side of the working piston 50 comes into contact with an inner surface 58 of the cylinder housing 52 arranged opposite. For example, the predefinable movement profile is designed such that initially a uniform acceleration of the working piston 50 occurs up to a predefinable target speed, then uniform movement of the working piston occurs with the target speed maintained and a final braking of the working piston 50 down to a decreasing speed.

A supply of pressurised fluid to working area 54 is needed for the planned movement of the working piston 50 while a removal of fluid from working area 53 is necessary. The provision of predefinable fluid volume flows is expedient to achieve the desired movement profile as this can be used to configure the movement speed for the working piston precisely. Accordingly, for example, control of valve element 4 and valve element 6 is to be provided, wherein the valve element 4 is used to create a fluidically communicating connection between fluid source 32, fluid junction 29 and the second fluid connection 39 and wherein valve element 6 is used to create a fluidically communicating connection between the first fluid connection 41, the fluid junction 31 and the fluid outlet with the assigned sound absorber 33.

In order to carry out the movement of the working piston 50 according to the movement profile set out above, the processing device 19 initially determines the sensor signals in the pressure sensors 42 to 45 in order to calculate the pressure conditions across the two valve elements 4 and 6. These pressure conditions can be used in a subsequent step to determine a flow value for each valve element 4, 6 from the two fluid pressures and a flow function in the processing device 19 for each of the valve elements 4, 6. The flow value determined is then linked to a predefinable fluid volume flow or fluid mass flow which needs to be provided to the respective working area 53, 54 to achieve the desired movement of the working piston 50 according to the movement profile. The result of this link is known as a fluid-related conductivity value and is needed to determine the actuating energy needed for the respective magnetic drive 8, 10. The actuating energy is determined for each of the magnetic drives 8, 10 by linking the fluid-related conductivity value to a characteristic valve curve, in particular one determined by means of an experiment. The actuating energy is then provided to the respective magnetic drive 8, 10 and leads to a movement of the respective valve slider (not described in greater detail) of the respective valve element 4, 6 and therefore to a release of a fluidically communicating connection between the respective fluid junctions 28 and 29 or 31 and 30.

By controlling the respective valve elements 4, 6, a fluid volume flow or a fluid mass flow is configured between the fluid source 32 and the working area 54 and between the working area 53 and the sound absorber 33, which is associated with a change in the pressures in the respective fluid lines 20 to 27. Cyclically recurring determination of the sensor signals from pressure sensors 42 to 45 and the subsequent processing of the pressure conditions according to the procedure mentioned above means the processing device 19 can set the fluid volume flows for both working areas 53, 54 of the compressed-air consumer 3 such that the desired movement profile is complied with for the working piston 50.

The invention claimed is:

1. A method for the supply of compressed air to a compressed-air consumer, the compressed air consumer having a first working chamber and a second working chamber, which are fluidically separated, and kinematically coupled, wherein the first working chamber is assigned to a first valve arrangement, wherein the second working chamber is assigned to a second valve arrangement, wherein the first valve arrangement and the second valve arrangement are independently controlled by a process controller for switching the first and second valve arrangement between a blocking position, a first functional position which allows a fluidically communicating connection of the respective working chamber with a fluid source and a second functional position which allows a fluidically communicating connection of the respective working chamber with a fluid sink, the method comprising:

providing a movement task for the compressed-air consumer to the process controller;

determining with the process controller a supply pressure, a first working chamber pressure, a second working chamber pressure, and a discharge pressure;

calculating with the process controller a first a fluid mass flow development in the first working chamber, which is necessary to fulfil the movement task for the compressed air consumer;

calculating with the process controller a second fluid mass flow development in the second working chamber, which is necessary to fulfil the movement task for the compressed air consumer;

calculating a first flow value for the first valve arrangement based on the supply pressure and the first working chamber pressure and a first flow function, said first flow function being related with the first valve arrangement;

calculating a second flow value for the second valve arrangement based on the supply pressure and the second working chamber pressure and a second flow function, said second flow function being related with the second valve arrangement;

calculating a first conductivity value based on the first flow value and the first fluid mass flow development;

calculating a second conductivity value based on the second flow value and the second fluid mass flow development;

determining a first actuating energy for energizing the first valve arrangement;

determining a second actuating energy for energizing the second valve arrangement;

providing the first actuating energy to the first valve arrangement to set a first fluid mass flow;

providing the second actuating energy to the second valve arrangement to set a second fluid mass flow;

providing the first fluid mass flow to the first working chamber to fulfil the movement task; and providing the second fluid mass flow to the second working chamber to fulfil the movement task.

2. The method according to claim 1, wherein there is aeration of a first working chamber with a predefinable developing for a first fluid mass flow and ventilation of a second working chamber with a predefinable developing for a second fluid mass flow to occur.

3. The method according to claim 1, wherein there is an aeration of a first working chamber with a predefinable developing for a first fluid pressure and a ventilation of a second working chamber with a predefinable developing for a second fluid mass flow or a predefinable developing for a valve position of the valve arrangement assigned to the second working chamber.

4. The method according to claim 1, wherein a position of an actuator element received in a flexible manner in an actuator housing can be determined using at least one fluid mass flow that flows through one of the valve arrangements.

5. The method according to claim 1, wherein the flow value is determined from the flow function which is related with a quotient of the first fluid pressure and the second fluid pressure and/or wherein the actuating energy is determined using the fluid-related conductivity value and a characteristic valve curve.

6. A data carrier with a program designed to be stored in a processing device of a valve device which initiates a method according to claim 1 during processing in a processor of the processing device.

7. A valve arrangement for the supply of compressed air to a compressed-air consumer, which comprises two fluidically separate, kinematically coupled working areas, wherein each of the working areas is assigned to the valve arrangement that can be independently controlled, wherein each of the valve arrangements comprises a fluid channel that is formed between an inlet connection for a fluidically communicating connection to a fluid source or fluid sink and an outlet connection for a fluidically communicating connection to a compressed-air consumer and a valve element that is arranged in a mobile manner in the fluid channel to influence a cross-section of the fluid channel and which valve element is assigned to an actuating device to change a functional position and a processing device to provide actuating energy to the actuating device, wherein a first pressure sensor is assigned to a first section of the fluid channel between the inlet connection and the valve element and wherein a second pressure sensor is assigned to a second section of the fluid channel between the valve element and the outlet connection, wherein the processing device is designed to carry out the following steps:

determining a supply pressure, a first working chamber pressure, a second working chamber pressure, and a discharge pressure;

calculating a first fluid mass flow development in the first working chamber, which is necessary to fulfil a movement task for the compressed air consumer;

calculating a second fluid mass flow development in the second working chamber, which is necessary to fulfil the movement task for the compressed air consumer;

calculating a first flow value for the first valve arrangement based on the supply pressure and the first working chamber pressure and a first flow function, said first flow function being related with the first valve arrangement;

calculating a second flow value for the second valve arrangement based on the supply pressure and the second working chamber pressure and a second flow function, said second flow function being related with the second valve arrangement;

calculating a first conductivity value based on the first flow value and the first fluid mass flow development;

calculating a second conductivity value based on the second flow value and the second fluid mass flow development;

determining a first actuating energy for energizing the first valve arrangement;

determining a second actuating energy for energizing the second valve arrangement;

providing the first actuating energy to the first valve arrangement to set a first fluid mass flow;

providing the second actuating energy to the second valve arrangement to set a second fluid mass flow;

providing the first fluid mass flow to the first working chamber to fulfil the movement task; and providing the second fluid mass flow to the second working chamber to fulfil the movement task.

8. The valve arrangement device according to claim 7, wherein the valve arrangement is designed as a proportional valve.

* * * * *